US005728014A

United States Patent [19]

Prunckle

[11] Patent Number: 5,728,014

[45] Date of Patent: Mar. 17, 1998

[54] BASEBALL FIELDER'S TRAINING DEVICE

[76] Inventor: Joseph Prunckle, 3720 Almeria St., San Pedro, Calif. 90731

[21] Appl. No.: 610,867

[22] Filed: Mar. 5, 1996

[51] Int. Cl.[6] ..... A63B 69/36

[52] U.S. Cl. ..... 473/422; 2/161.2

[58] Field of Search ..... 273/26 R, 26 C; 473/207, 208, 209, 212; 2/161.2

[56] References Cited

U.S. PATENT DOCUMENTS

| | | | |
|---|---|---|---|
| 3,707,291 | 12/1972 | Dedway | 2/161.2 |
| 3,861,688 | 1/1975 | Butler | 473/212 |
| 4,193,065 | 3/1980 | Bittner | 473/212 |
| 4,527,982 | 7/1985 | Salzman | 473/209 |
| 5,199,712 | 4/1993 | Hoyle | 473/212 |
| 5,324,038 | 6/1994 | Sasser | 473/212 |
| 5,509,809 | 4/1996 | Clay | 473/212 |

OTHER PUBLICATIONS

Popular Science, Jul. 1982 p. 63.

*Primary Examiner*—Theatrice Brown
*Attorney, Agent, or Firm*—I. Michael Bak-Boychuk

[57] ABSTRACT

A training attachment useful in reinforcing proper glove positioning in the course of fielding a baseball includes a switch assembly that is provided with a switching lever and that is securable to the back of the glove. When thus secured the switching lever extends beyond the glove digit ends, to be deflected against the ground. A buzzer may then be attached to the body of the player connected by a harness to the switch. In this manner correct glove alignment in anticipation of the incoming baseball deflects the lever, thus exciting the buzzer.

7 Claims, 2 Drawing Sheets

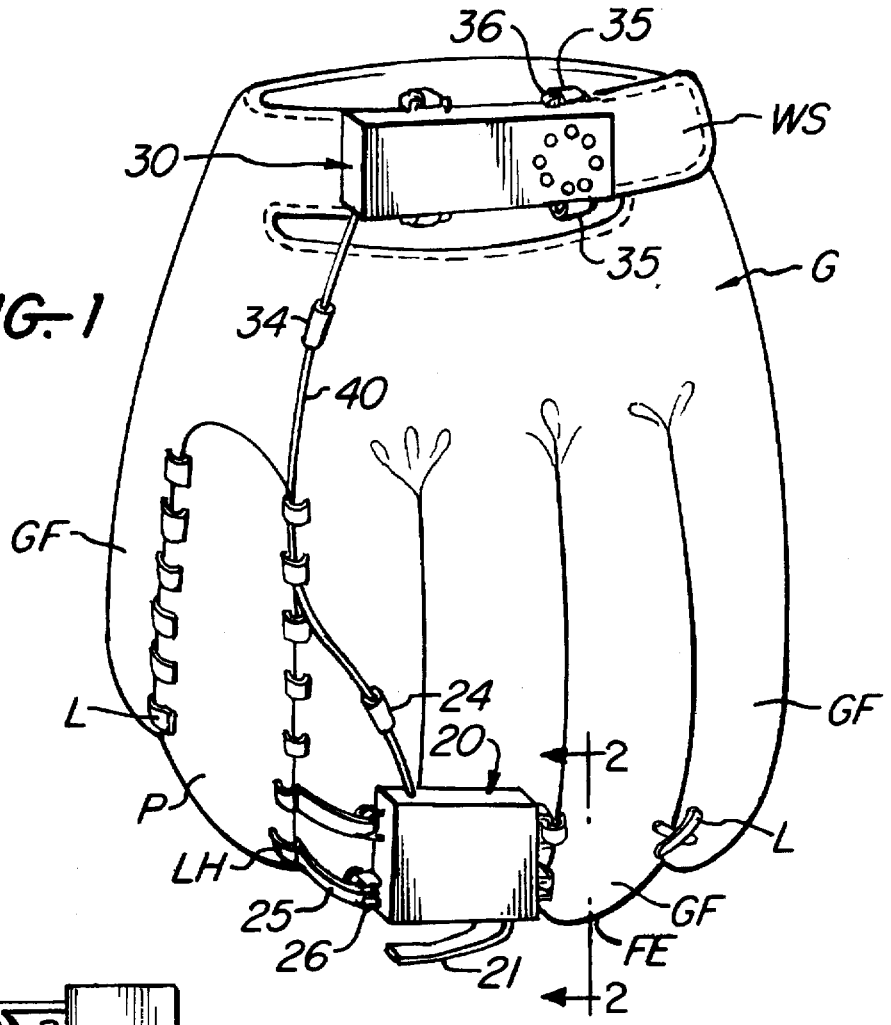
FIG.-1
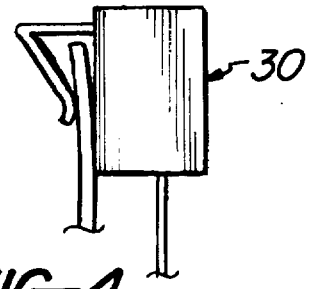
FIG.-4
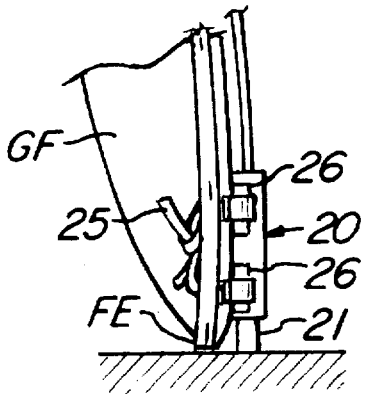
FIG.-2
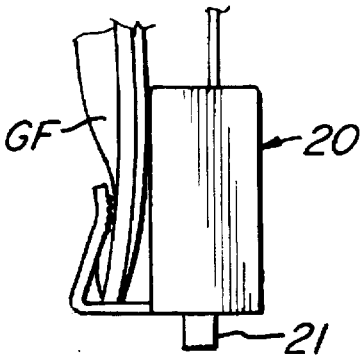

BASEBALL FIELDER'S TRAINING DEVICE

BACKGROUND OF THE INVENTION

1. Field of the Invention

The present invention relates to training devices for athletes, and more particularly to electrical switch attachments for indicating the proper glove position effected by a baseball fielder in the course of receiving a ground ball.

2. Description of the Prior Art

The development of proper skills in the game of baseball entails several specific and distinct proficiencies. For example, a completely trained baseball player engages in batting, fielding, and sometimes pitching, all with substantial ease. Each of these activities involves separate muscular groups, different levels of strength, and various demands on coordination and athletic ability. In each instance, however, small modifications in body position and movement produce significant improvements in the result and the coach's task is to train and reinforce these adjustments.

In the past various training aids have been devised that in one way or another assist in the development of proper techniques. For example, U.S. Pat. No. 5,354,050 issued to McCarthy on Oct. 11, 1994 teaches an arm position alignment band that is particularly useful in developing baseball throwing techniques. U.S. Pat. No. 5,346,208 issued to Wood, Sr. on Sep. 13, 1994, in turn, describes a baseball glove exterior stiffener conformed to control the glove opening in the course of play. In U.S. Pat. No. 5,324,038 issued to Sasser on Jun. 28, 1994 a set of transducers monitors the articulation of a golfer's wrist, and U.S. Pat. Nos. 3,861,688 issued on Jan. 21, 1975 to Butler and 3,350,100 issued to Carmines on Oct. 31, 1967, describe further structures for monitoring golfers' arm and wrist positions in the course of a swing. Each of these, while suitable for the purposes intended, attends a specific training function of skeletal or muscular alignment. The indoctrination of proper baseball fielding habits, however, has had little attention, particularly since there is no single body position that is entailed.

The fielding of a sharply struck ground ball, in itself, entails proper anticipation, correctly positioned body alignment, and a proper alignment of the fielder's glove, all to minimise errors. From the coach's remote vantage the anticipation and body movement are perceivable at a distance and can thus be corrected by observation. The alignment of the fielder's glove, however, is a matter of small motions best trained by reinforcement on the fielder's part.

More precisely, the best glove position in the course of fielding a ground ball is generally vertical with the distal glove edge touching the ground. This alignment reduces the incidence of missing the ground ball under the glove or having it bounce out of the glove and over the player. This anticipatory glove alignment, however, is a matter of small corrections that are difficult to coach and are best resolved by instrumentation.

A training mechanism that reinforces these small glove alignment movements is a matter of some advantage, and it is one such mechanism that is disclosed herein.

SUMMARY OF THE INVENTION

Accordingly, it is the general purpose and object of the present invention to provide a training mechanism useful in developing proper glove alignment habits in the course of fielding a ground ball.

Other objects of the invention are to provide a detachable instrumentation array useful in training proper fielding habits.

Further objects of the invention are to provide a simple training aid for baseball fielders that is conveniently attached to the fielder's glove.

Briefly, these and other objects are accomplished within the present invention by providing a microswitch assembly conformed for laced or other attachment to the ends of the glove fingers of a fielders glove. A buzzer provided with a battery is connected in circuit with the microswitch, in yet another assembly that may be laced or otherwise attached to the body of the glove.

Preferrably, the deployment of the microswitch assembly on the fielder's glove presents the switching lever thereof adjacent the glove finger ends. Thus to close the switch, thereby exciting the buzzer, the fielder is compelled to place the glove finger ends against the ground, the alignment then directing a vertical glove position, reinforced by the buzzer sound. In this compelled fielding position of the glove hand the incidence of a ground ball passing under the glove is reduced, as is the unwanted upward rebound of the ball.

More importantly, the invention allows for proper development of fielding habits without the direct attention of the coach, in an inexpensive assembly that is conveniently attached by the player.

BRIEF DESCRIPTION OF THE DRAWINGS

FIG. 1 is a perspective illustration of a baseball fielder's glove provided with the inventive training assembly;

FIG. 2 is a detail side view taken along line 2—2 of FIG. 1, illustrating the ground contact effected by the inventive training assembly;

FIG. 4 is a side view of an alternative implementation of the manner of attachment of the inventive assembly.

DESCRIPTION OF THE PREFERRED EMBODIMENT

Figure 3:
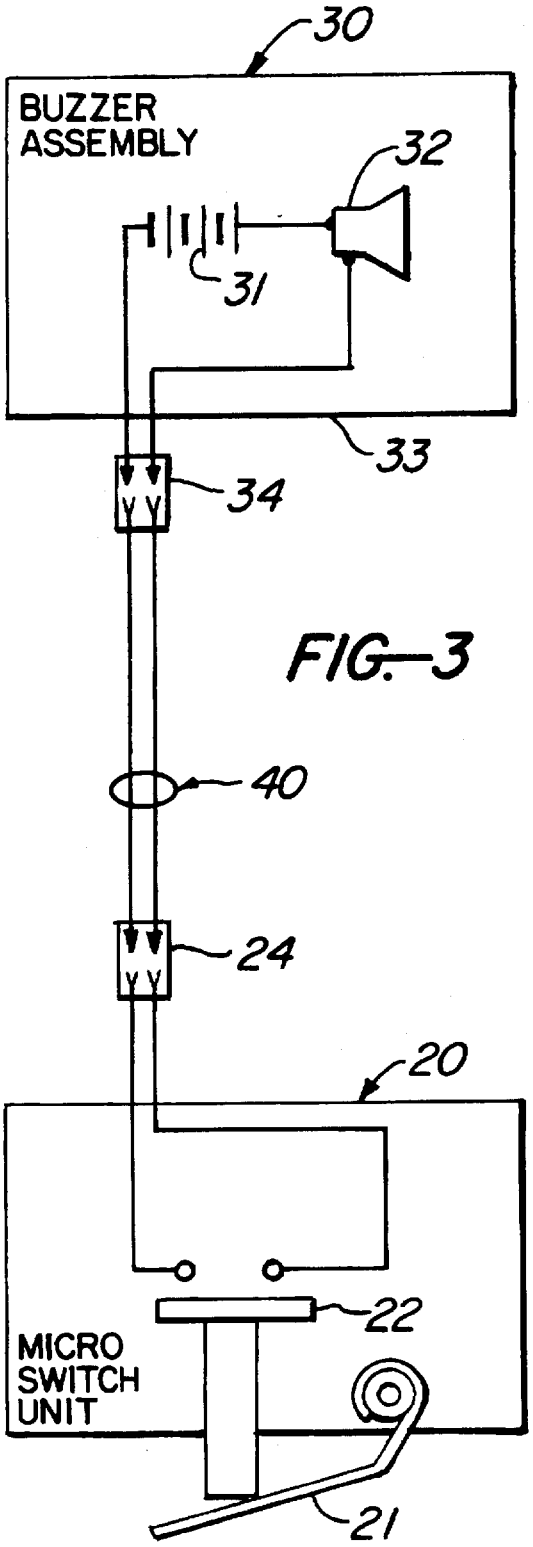
FIG. 3 is a circuit diagram illustrating the circuit effected by the present invention.

As shown in FIGS. 1–3, the inventive training assembly, generally designated by the numeral 10, comprises a microswitch unit 20, a buzzer assembly 30, and a selectively completed circuit harness 40. The foregoing components of the training assembly are used in conjunction with a conventional baseball fielder's glove G, characterised by a plurality of glove fingers GF laced to each other by lacing L to form a ball receiving pocket P. In conventional practice, the lacing tension between the glove fingers may be adjusted by the player, thus conforming the glove to the player's physical and manipulative preference. Moreover, the oversized attributes of the glove G, provided to improve the facility of fielding a baseball, and the flexible material structure of the glove necessary to attenuate rebound on ball receipt, both impose a fitting requirement to the fielder's palm that is effected by lacing. Thus the lacing L, and the necessary lacing holes LH, are a typical part of a conventional glove structure.

In the invention herein these attributes of the glove G are used to advantage. More precisely the microswitch unit 20 may be selectively attached by lacing to the back of the glove fingers GF. This laced attachment aligns the unit 20 proximate the free ends of the fingers GF, presenting a switch lever 21 beyond the free edge FE of the glove finger. In this position the lever 21 will be pushed to close the microswitch 22 in the unit when the glove end is pressed vertically to the ground. The player, therefore, is induced to this ground contacting position by the deployment of the switching lever 21.

Switch 22, closed by the defelection of the lever, is in circuit between a battery 31 and a buzzer 32, both contained in a housing 33 forming the buzzer assembly 30. To effect this circuit connection a set of jacks 34 extends to the exterior of the housing, conformed for connection to the ends of a dual lead harness 40 which, at the other end, is connected to the terminals 24 of switch 22. This harness arrangement allows for the deployment of the buzzer at any convenient body location, illustrated herein in attachment of the assembly 30 to the back of the glove strap, lacing 25 securing the switch assembly 20 to the glove finger ends. To effect such attachment assembly 20 and unit 30 may each include exterior eyelets 26 and 36 in their first construction.

While the deployment of the buzzer unit may be variously accomplished, the preferrable attachment point is to the wrist strap WS typically provided in the structure of glove G. In this position a geometrically coherent combination of the signal source and the trained limb of the player is achieved, further improving the efficacy of the inventive assembly.

Figure 5:
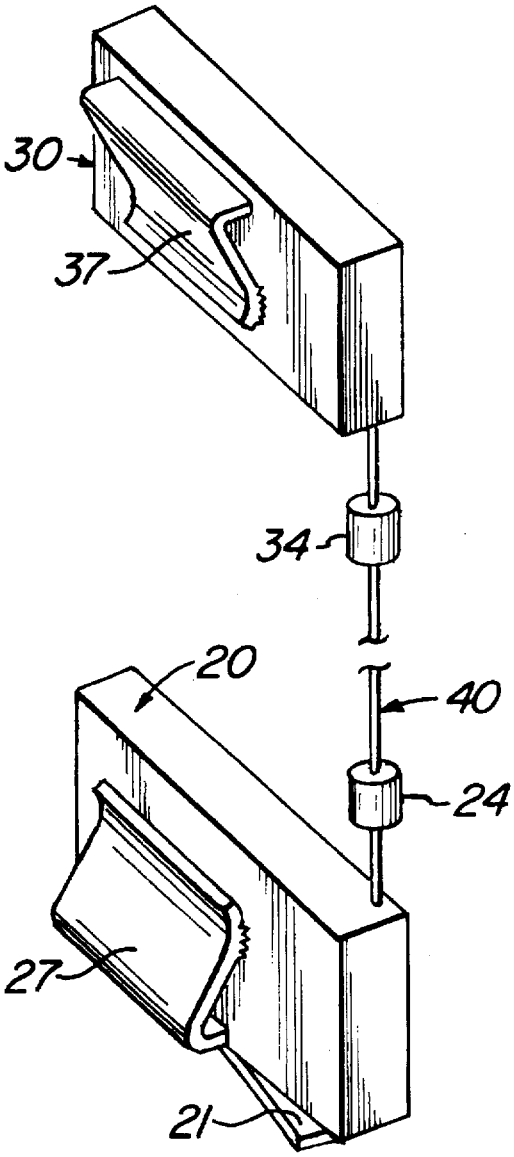
FIG. 5 is a perspective illustration of the assembly shown in FIG. 4.

These same aspects may be used to advantage in the second implementation illustrated in FIGS. 4 and 5, wherein like numbered parts function in a like manner as that previously set out. In this implementation switch unit 20 and assembly 30 are each provided with exterior flexible clips 27 and 37, clip 27 being conformed to grasp the finger ends FE while clip 37 engaging the wrist strap WS. This structure then renders the training assembly convenient in mounting and removal, an aspect of some advantage when a large number of players are to be trained.

It should be noted that the foregoing training device is useful both in a coached setting, and as a practice mechanism without tutorial attention. Thus the player can acquire proper fielding habits on his own, the deployment of the microswitch directing proper glove alignment. In addition, the minimal structures of the switch 22 and the buzzer 32 provide little player interference, and the assembly can thus be worn in most play settings. In this manner a convenient, inexpensive, and easily worn training arrangement is devised that is easily fabricated and used. More importantly, the deployment of the switch lever 21 is aligned to the rear of the glove, thus allowing for the sweeping motion towards the incoming ball. This same deployment of the lever 21 may be aligned to fit between the inter-digit spacing of the glove, and may include an expanded end surface 21*a* at the free end to distribute ground contact.

Obviously many modifications and variations of the foregoing teachings may be effected without departing from the spirit of the invention. It is therefore intended that the scope of the invention be determined solely by the claims appended hereto.

What is claimed is:

1. A training assembly useful in reinforcing the proper fielding motions of a baseball glove by a player towards the playing field ground surface, said glove being defined by a pocket portion, a plurality of finger projections extending from said pocket portion, a rear membrane attached to the edges of said pocket portion and said finger projections, and lacing adjustably connecting said finger projections to each other, comprising:

microswitch means attachable by lacing to said rear membrane of said glove and including a switch, a pivoted lever connected to said switch for closing said switch upon the articulation thereof by contact with said ground surface, said lever being deployed to project beyond the distal ends of said finger projections upon the attachment of said microswitch means for exposure to contact with said ground surface;

signaling means attachable to the body of said player and including a signaling device and a battery; and harness means connected between said microswitch means and said signaling means for connecting said signaling device to said battery upon the closure of said switch.

2. Apparatus according to claim 1, wherein said signaling device comprises an electrical buzzer.

3. Apparatus according to claim 2, further comprising:

securing means engaged to said signaling and harness means for selective attachment thereof along the body of said player.

4. Apparatus according to claim 3, wherein:

said glove includes a wrist strap; and said signaling means is securable to said wrist strap.

5. A training assembly useful in reinforcing the proper fielding motions of a baseball glove by a player towards the playing field ground surface, said glove being defined by a pocket portion, a plurality of finger projections extending from said pocket portion, a rear membrane attached to the edges of said pocket portion and said finger projections, and a wrist strap for adjusting the fit of said glove, comprising:

microswitch means selectively attachable to said rear membrane of said glove and including a switch, a pivoted lever connected to said switch for closing said switch upon the articulation thereof by contact with said ground surface, said lever being deployed to project beyond the distal ends of said finger projections upon the attachment of said microswitch means for exposure to contact with said ground surface;

signaling means attachable to the body of said player and including a signaling device and a battery; and harness means connected between said microswitch means and said signaling means for connecting said signaling device to said battery upon the closure of said switch.

6. Apparatus according to claim 5 wherein:

said signaling means includes a buzzer and a battery connected to each other by said harness means.

7. Apparatus according to claim 5, wherein:

said signaling means includes a resilient clip for attachment to said wrist strap; and said microswitch means includes a resilient clip for attachment to said glove finger ends.

* * * * *